United States Patent [19]

Benson

[11] Patent Number: 4,597,206

[45] Date of Patent: Jul. 1, 1986

[54] SNAP TOGETHER BADGE AND CLIP

[76] Inventor: Ryan H. Benson, 2023 Mallory St. SW., Cedar Rapids, Iowa 52404

[21] Appl. No.: 658,924

[22] Filed: Oct. 9, 1984

[51] Int. Cl.[4] ..... A44C 3/00

[52] U.S. Cl. ..... 40/1.5; 40/1.6; 24/13; 24/356; 24/368; 24/103

[58] Field of Search ..... 40/1.5, 1.6; 24/13, 24/6, 368, 356, 103

[56] References Cited

U.S. PATENT DOCUMENTS

| | | | |
|---|---|---|---|
| 1,055,453 | 3/1913 | Durnan | 40/152 |
| 1,765,325 | 6/1930 | Day | 40/1.5 |
| 1,785,186 | 12/1930 | Day | 40/1.5 |
| 1,849,904 | 3/1932 | Bott | 40/1.5 |
| 1,867,964 | 7/1932 | Bott | 40/1.5 |
| 2,145,296 | 1/1939 | Draper et al. | 40/1.5 |
| 2,232,060 | 2/1941 | Foster | 40/1.5 |
| 2,338,264 | 1/1944 | Shaw et al. | 40/1.5 |
| 3,212,204 | 10/1965 | Smith | 40/1.5 |
| 3,256,626 | 6/1966 | Stoffel | 40/1.5 |
| 3,407,523 | 10/1968 | Winston | 40/1.5 |
| 3,557,478 | 1/1971 | Sitzberger | 40/1.5 |
| 4,183,159 | 1/1980 | Isaac | 40/1.6 |

*Primary Examiner*—Robert Peshock
*Assistant Examiner*—Cary E. Stone
*Attorney, Agent, or Firm*—Allan L. Harms

[57] ABSTRACT

A snap together display badge intended to be worn on a person's clothing as a name badge, display button or the like. An open frame equipped with front and rear ridges receives a transparent cover, the display material, and a backplate through the rear, the cover abutting the front ridges and the backplate passing interferingly by the rear ridge. An S-shaped wire clasp is detachably affixed to the backplate by means of a snap attachment made up of ramp elements and protrusions positioned in paired arrangement about an opening in the backplate and a bridge element traversing the opening. The S-shaped body of the clasp is received by the supports of the bridge when the ends of the clasp body are passed over the ramp elements and into position between the protrusion and ramp of each of the pairs thereof.

11 Claims, 6 Drawing Figures

SNAP TOGETHER BADGE AND CLIP

CROSS REFERENCES

Related inventions are the subject of Design patent application Ser. Nos. 540,963 and 540,750 now pending.

BACKGROUND OF THE INVENTION

Temporary nameplates, nametags, badges or buttons are commonplace in our world. They are issued to people attending conventions, meetings, parties, and are worn by people who merely want to display some visual item on their person. These temporary nameplates, nametags, badges or buttons commonly consist of a flat display area affixed to a clip or clasp which can be temporarily fastened to clothing. Such nametags or badges may range from an adhesively backed paper nametag to the relatively permanent metal button which must be assembled, compressed and crimped with the displayed material inside. A common implementation of the nametag is the folded clear film shaped to receive a flat stiff paper containing typed or other printed or written information. A simple wire clasp is installed to such a transparent case, to allow attachment to clothing. Each of these forms of badge or nametag each a limitation. Adhesive-backed paper nametags are easily worked loose from the clothing to which they are to adhere. Once detached from the clothing the adhesive is reduced in effectiveness. The information-carrying part of the badge is not protected. This type of badge quickly becomes worn and deteriorated by the flexing movements of the clothing to which it is affixed.

The folded clear film badge has its own shortcomings. The information to be displayed must be inserted into the transparent carrier by sliding into the end or by disassembly and reassembly of the badge. This is possible because the transparent carrier is a folded stiff material which has no fasteners securing it together. The information is susceptible of slipping out of either end of the badge. The transparent carrier can be unfolded by accidental engagement with other items, such as by brushing against another person. In addition, the stiff nature of the transparent carrier is unavoidably equipped with sharp edges and corners. The spring clasp commonly used with this type of badge cannot be sufficiently secured to the transparent carrier to be very stable.

A third commonly used badge is a metal based circular device which must be assembled with a tool which can exert sufficient force to crimp the metal parts of the badge together. Once fabricated, the badge is a suitable one, with a transparent cover over the information-carrying portion, and with a secure clasp welded or glued to the badge rear surface. However, the necessity of a machine operation in its assembly detracts from its value. Also, such badges are not susceptible to undamaged disassembly for reuse.

The shortcomings of the existing technology could be avoided with a badge which can be quickly assembled or disassembled with a person's fingers, and which can carry the clasp in a secure, yet quickly applied fashion without the need of adhesive, welding or soldering.

SUMMARY OF THE INVENTION

The instant invention relates to badges, nametags, nameplates, identification buttons and the like. A snap together information-carrying button is provided which comprises a narrow open frame having a first set and a second set of protrusions depending from said frame to the enclosed area of said frame, a thin transparent cover of a shape to be capturingly received by said frame and abutting the first set of said ridges, a thin backplate of shape to be capturingly received by said frame and abutting said second set of ridges, a wire clasp having an S-shaped body receivable by clip receiving portions of said back plate, said clip receiving portion of said backplate comprising an opening in said backplate which is small relative to the length of said wire clasp, a member raised a fixed distance above the plane of said backplate and bridging said opening and having supporting ends attaching said raised member to said backplate, said distance between said plane of said backplate and said raised member being approximately equal to the diameter of the body of said wire clasp, a pair of protrusions depending from said backplate and positioned in diametrically opposing fashion relative to said opening a fixed distance from the ends of said raised portion, a pair of inclined protrusion depending from said backplate in diametrical opposing fashion, with the inclined surfaces thereof positioned in the direction of the first protrusion.

An object of the invention is to provide a display badge which can be assembled as needed without special equipment.

Another object of the invention is to provide a display badge which can be disassembled without damage and reused.

Another object of the invention is to provide a display badge which can be quickly assembled by the end user.

Another object of the invention is to provide a display badge which can be assembled at the site of use such as a meeting/conventions where temporary nametags are frequently employed and provided for immediate use at the site of the meeting/convention.

Another object of the invention is to provide a display badge with an inexpensive wire clasp that can be affixed to the badge by the end user without special tools.

Another object of the invention is to provide a display badge with a clasp that can be removed from the badge without damage to the badge or clasp.

Another object of the invention is to provide a display badge that allows the wearer to exchange the information displayed within the badge without damage to the information removed or to the badge.

These and other objects will be more readily understood upon reference to the accompanying specification.

DETAILED DESCRIPTION OF THE INVENTION

Figure 1:
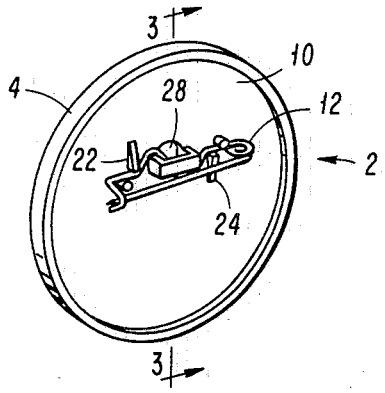
FIG. 1 is a perspective view of the clip side of the invention.
Figure 2:
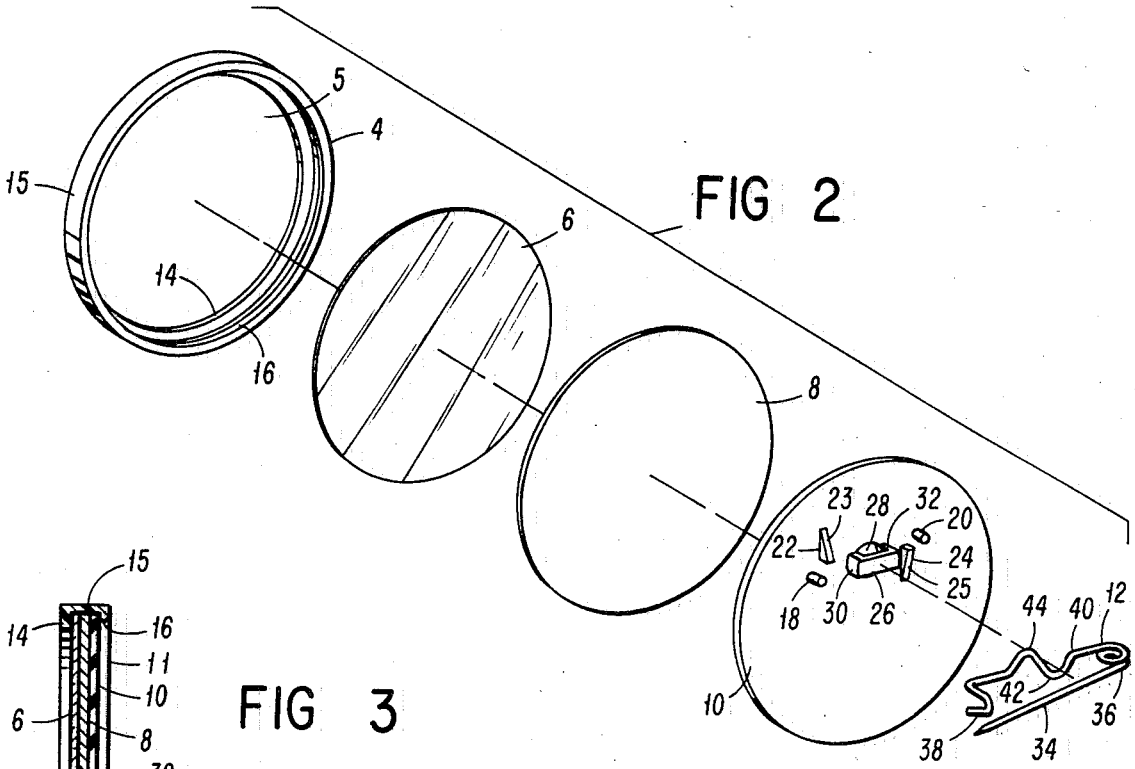
FIG. 2 is an exploded view in perspective of the individual components of the invention.

FIG. 1 discloses the assembled invention 2 in perspective view, from the rear, with wire clasp 12 affixed to back plate 10. Reference to this figure and to FIG. 2 will assist in understanding the assembly of the invention. In FIG. 2, the invention 2 is shown in exploded view. Frame 4 is an endless band which encloses area 5. In FIG. 2, frame 4 is depicted as circular. It is to be understood that rectangular, square, or any other polygonal, or curvilinear shape may be used so long as the shapes of cover 6 and back plate 10 are substantially identical to the shape of enclosed area 5. Depending from frame 4 into the enclosed area 5 is flange 14. Flange 14 may be a continuous ridge, a plurality of ridges, or may comprise a plurality of protrusions spaced around rim 15 of frame 4. Because flange 14 operates as a stop to cover 6, if flange 14 is to be substituted by a plurality of ridges or a plurality of protrusions, such ridges or protrusions must be disposed in a generally symmetrical fashion about rim 15.

Cover 6 is a thin element which may be placed in frame 4 by finger pressure by passing cover 6 past second ridge 16. Typically cover 6 is a substantially transparent element though it may be tinted in color, or it may carry striations, or it may comprise a lens. Cover 6 must be of size and shape to resist passage past flange 14 (or plurality of protrusions or ridges substituted therefore as described above).

Ridge 16 depends periferally from rim 15 at a fixed distance from flange 14. Ridge 16 may alternatively comprise a spaced plurality of ridges or a plurality of protrusions, which, though not shown, are contemplated by the invention. As with flange 14, if a plurality of spaced ridges or a plurality of protrusions are utilized to serve in place of ridge 16, generally symmetrical arrangement of such ridges or protrusions must be employed to successfully retain back plate 10 within frame 4.

Figure 3:
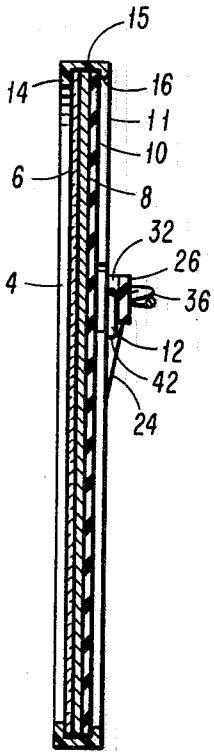
FIG. 3 is a view in section along line 33 of FIG. 1.

Referring now to FIG. 3, it can be seen more effectively that ridge 16 depends inwardly from rim 15 of frame 4. Display material 8 is necessarily of a shape and size to fit within frame 4 and, to be most aesthetically pleasing, display material 8 will be substantially identical in size and shape to cover 6. Back plate 10 backs display material 8 to retain display material 8 behind cover 6. Back plate 10 is sized to permit its interfering passage into frame 4 past ridge 16.

In the preferred embodiment shown, flange 14 is affixed at the front edge of rim 15 while ridge 16 is affixed at the rear edge of rim 15.

Figure 4:
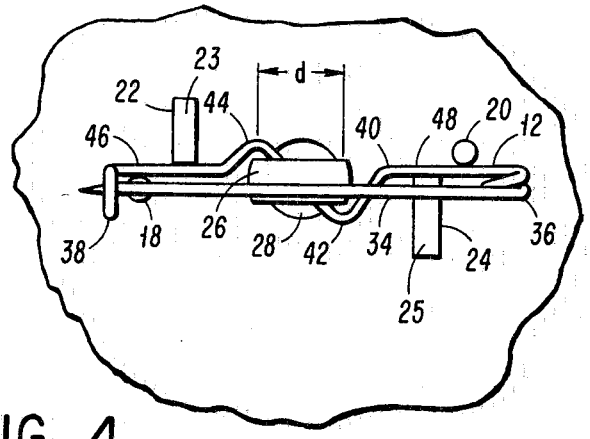
FIG. 4 is a view partially cut away showing the detail of the installation of the clip to the back plate of the invention.

Reference is now drawn to FIG. 4 as well as FIGS. 1 and 2. Wire clasp 12 is mounted to back plate 10. It is intended that this mounting be detachable and be possible by hand manipulation. Wire clasp 12 is a well known and standardized clasp design of formed wire and has a base section 40 generally formed in the shape of a letter S, and base section 40 has a free latch end 38, opposing bends 42 and 44, and a loop spring 36 at its other end. The remainder of wire clasp 12 is a pin 34 which may be passed through clothing and latched by latch end 38.

Latch end 38 of wire clasp 12 is passed below ridge element 26 during installation of wire clasp 12 to back plate 10. Opening 28 is provided in back plate 10 below bridge element 26 to allow passage of latch end 38 of wire clasp 12 below bridge element 26. Base section 40 of wire clasp 12 is passed below bridge element 26 to a point where first bend 44 emanates from below bridge element 26 and second bend 42 is about to begin passage under bridge element 26. Wire clasp 12 is then rotated manually such that first bend 44 receives first support 30 of bridge element 26 and second bend 42 receives second support 32 of bridge element 26. The distance separating first support 30 and second support 32 of bridge element 26 is shown by dimension d in FIG. 4, and is generally equal to the linear distance between bend 44 and bend 42 of base section 40 of wire clasp 12. In this rotation of clasp 12, first segment 46 of base section 40 is forced along inclined surface 23 of first ramp 22 while second segment 48 of base section 40 is passed up inclined surface 25 of second ramp 24. First segment 46 of base section 40 of wire clasp 12 passes into position between first ramp 22 and first protrusion 18, while second segment 48 of base section 40 passes into position between second ramp 24 and second protrusion 20. The clearance between bridge element 26 and the plane of back plate 10 is substantially the same dimension as the thickness of base 40 of wire clasp 12. The wire clasp 12 is thereby held in firm position relative to back plate 10. This design also allows clasp 12 to be manually removed by manipulation in reverse of the order of installation.

Protrusions 18 and 20 are positioned upon back plate 10 relative to ramps 22 and 24 respectively to provide snug retention of base section 40 of clasp 12 therebetween.

The assembled invention 2 is shown in section in FIG. 3. This section view is taken along line 3—3 of FIG. 1. Endless rim 15 of frame 14 has flange 14 formed along the perifery of rim 15 and projecting inwardly. Spacially displaced from flange 14 is periferal ridge 16 depending inwardly from rim 15. The spacial displacement between flange 14 and ridge 16 is substantially equal to the combined thicknesses of cover 2, display material 8 and back plate 10, in order to provide the preferably snug, abutting contact between cover 6 and flange 14, between cover 6 and display material 8, and between display material 8 and back plate 10. The projection of ridge 16 from rim 15 is relatively small to allow hand assembly of the invention, as well as to allow easy disassembly of the invention. Furthermore, the corners of ridge 16 are rounded to ease the passage of cover 6 and back plate 10 into frame 4. It should be noted that optional stuffing material may be added between display material 8 and back plate 10 in the event display material 8 is of exceptionally thin composition, or in the event cover 6 and display materal 8 are of a convex or other non-planar shape.

Bridge element 26 is mounted above the rear surface 11 of back plate 10 by support 32 which is of height substantially equal to the thickness of clasp 12.

Figure 6:
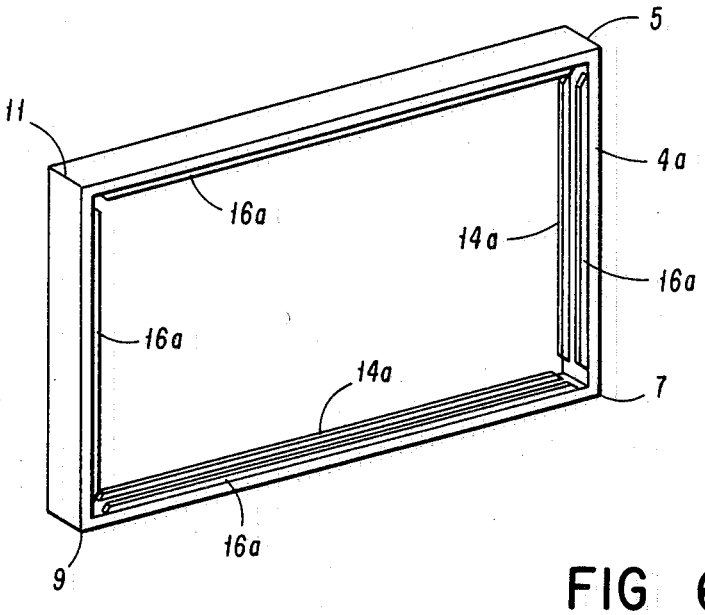
FIG. 6 is perspective view of a noncurvilinear embodiment of the frame element of the invention, including a first plurality of ridges and a second plurality of ridges depending inwardly from said frame.

FIG. 6 discloses an alternative of the invention wherein frame 4*a* is noncurvilinear, having corners 5, 7, 9 and 11. First plurality of ridges 14*a* depend inwardly from frame 4*a* and may be substituted for flange 14 shown in FIG. 2. Second plurality of ridges 16*a* depend inwardly from frame 4*a*, at a fixed distance from first plurality of ridges 14*a*. As can be seen in FIG. 6, first plurality of ridges 14*a* and second plurality of ridges 16*a* each are discontinuous at corners 5, 7, 9 and 11.

Figure 5:
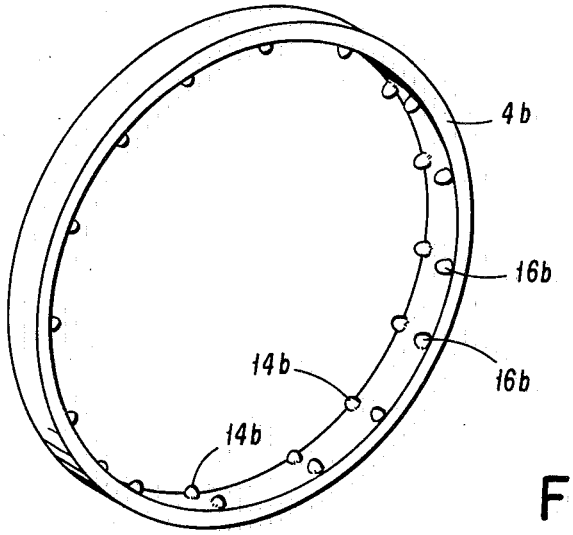
FIG. 5 is a perspective view of the curvilinear form of the frame portion of the invention showing the alternative embodiment employing a first and second plurality of ridges depending from said frame.

Protrusions 14b shown in FIG. 5 may serve as a substitute for flange 14 of FIG. 2, as described earlier in this application. Second plurality of protrusions 16b, depending inwardly from frame 4b may serve as substitutes for ridge 16 of FIG. 2. Said plurality of protrusions 16b are spaced apart from said second plurality of protrusions 14b.

Having thus described the invention, I claim:

1. In a display badge intended to be attached to the clothing of the wearer, said badge having a generally planar backplate thereupon, apparatus for attaching a fastening device to said backplate, the apparatus for attaching comprising a wire clasp having an S-shaped body, said backplate having a rear surface, said backplate having an opening therethrough, said backplate having a pair of ramp elements mounted upon said rear surface of said backplate, said ramp elements located in substantially diametrically opposing relationship relative to said opening, said backplate having a pair of protrusions depending from said rear surface of said backplate, said pair of protrusions positioned in diametrically opposing relationship therebetween, relative to said opening, each of said protrusions being selectively positioned in pairing relationship to each of said ramp elements, each of said ramp elements having an inclined surface thereupon, said inclined surface of each of said ramp elements having a first end coincident with said backplate and a second end disposed a fixed distance from said backplate, each of said protrusions being positioned a fixed distance from the second end of said inclined surface of said ramp elements, a bridge element traversing said opening, said bridge element positioned such that a line through the axis of said bridge element passes adjacent the second end of the inclined surface of each of said ramp elements, said bridge element positioned a fixed distance from the plane of said backplate and substantially parallel thereto, said bridge element having a pair of supports at each end thereof interconnecting said bridge to said backplate, said S-shaped body of said wire clasp receivable between said bridge and said backplate, said supports of said bridge element received by the curves of said S-shaped body of said wire clasp, said body of said wire clasp rotatingly passing along the inclined surfaces of each of said ramp elements and being received between said paired protrusions and ramp elements.

2. The invention of claim 1 wherein said opening through said backplate is generally centrally located thereupon.

3. The invention of claim 1 wherein said pair of protrusions depend substantially perpendicularly from the rear surface of said backplate.

4. The invention of claim 1 wherein said bridge element is diametrically positioned relative to said opening.

5. The invention of claim 1 wherein said distance between said bridge and said backplate is substantially equal to the diameter of said S-shaped body of said wire clasp.

6. A display badge for display of information or decorative matter, to be worn attached to the clothing of the wearer comprising an open frame comprising a narrow endless band enclosing a fixed area, a substantially transparent cover which is receivable by said frame, a backplate which is insertable within said frame, said area enclosed by said open frame being substantially identical in shape to the shapes of said cover and said backplate, said open frame having a first plurality of protrusions depending from said frame into the enclosed area of said frame, said protrusions arranged upon said frame in generally symmetrical relationship, said open frame having a second plurality of protrusions depending from said frame into the enclosed area of said frame, said second plurality of protrusions disposed a fixed distance from said first plurality of protrusions, said transparent cover abutting said first plurality of protrusions when said transparent cover is received by said open frame, said second plurality of protrusions being of such size to permit the interfering passage of said backplate into said open frame, said fixed distance between said first plurality of protrusions and said second plurality of protrusions being substantially equal to the thickness of said cover, said backplate, and the information or other printed matter to be displayed in said badge, said printed matter being inserted within said open frame to abut said substantially transparent cover, said backplate being received by said open frame and abutting said printed matter, said backplate having a rear surface disposed to the exterior of said badge when said backplate is inserted within said frame, said backplate having a fastener for detachable fastening of said display badge to the clothing of the wearer, said backplate has an opening therethrough, said backplate has pair of ramp elements formed upon said backplate, said ramp elements are formed in diametrically opposing relationship with reference to said opening, said backplate has a pair of protrusions depending from said backplate, said pair of protrusions positioned in diametrically opposing relationship with reference to said opening, each of said ramp elements having an inclined surface, the portion of said inclined surface of each of said ramp elements which is most distant from the plane of said backplate being a fixed distance from said protrusions, a bridge element traversing said opening, said bridge element positioned such that a line through the axis of said bridge element passes adjacent the portion of the inclined surface of said ramp elements most distance from the plane of said backplate, said bridge element positioned a fixed distance from the plane of said backplate and parallel thereto, said fastener comprising a wire clasp having an S-shaped body receivable within the space between said bridge element and the plane of said backplate and positioned such that each end of the body of said wire clasp is receivable within the space between each of said ramps and each of said protrusions.

7. The invention of claim 6 wherein the opening of said backplate is centrally located thereupon.

8. The invention of claim 6 wherein said pair of protrusions depends substantially perpendicularly from said backplate.

9. The invention of claim 6 wherein said pair of protrusions is a pair of substantially perpendicular posts.

10. The invention of claim 6 wherein said bridge element is diametrically positioned with respect to said opening.

11. The invention of claim 6 wherein said wire clasp is removable from said backplate by hand manipulation.

* * * * *